US007628941B2

(12) United States Patent
Krause et al.

(10) Patent No.: US 7,628,941 B2
(45) Date of Patent: Dec. 8, 2009

(54) PROCESS AND APPARATUS FOR FORMING UNIFORM NANOFIBER SUBSTRATES

(75) Inventors: Tim Krause, Mooresville, NC (US); Rick Ferencz, Isle of Palms, SC (US); Rajeev Chhabra, Mason, OH (US); Olaf Isele, West Chester, OH (US); Han Xu, West Chester, OH (US)

(73) Assignee: Polymer Group, Inc., Charlotte, NC (US)

( * ) Notice: Subject to any disclaimer, the term of this patent is extended or adjusted under 35 U.S.C. 154(b) by 0 days.

(21) Appl. No.: 12/095,329

(22) PCT Filed: Apr. 19, 2006

(86) PCT No.: PCT/US2006/014719

§ 371 (c)(1),
(2), (4) Date: May 29, 2008

(87) PCT Pub. No.: WO2006/113791

PCT Pub. Date: Oct. 26, 2006

(65) Prior Publication Data

US 2009/0039564 A1 Feb. 12, 2009

Related U.S. Application Data

(60) Provisional application No. 60/672,676, filed on Apr. 19, 2005.

(51) Int. Cl.
*B27N 3/00* (2006.01)

(52) U.S. Cl. ..... 264/12; 264/6; 425/7; 156/167

(58) Field of Classification Search ..... 264/12; 425/7

See application file for complete search history.

(56) References Cited

U.S. PATENT DOCUMENTS

| | | | |
|---|---|---|---|
| 2,571,457 | A | 10/1951 | Ladisch |
| 3,615,995 | A | 10/1971 | Buntin et al. |
| 4,363,646 | A | 12/1982 | Torobin |
| 4,536,361 | A | 8/1985 | Torobin |
| 5,075,068 | A | 12/1991 | Milligan et al. |
| 5,080,569 | A | 1/1992 | Gubernick et al. |

(Continued)

OTHER PUBLICATIONS

International Search Report, priority application No. PCT /US06/14719, Form PCT/ISA/210-FormPCT/ISA/220, Oct. 12, 2006, 2 pages.

(Continued)

*Primary Examiner*—Mary Lynn F Theisen
(74) *Attorney, Agent, or Firm*—Kilyk & Bowersox, PLLC; Valerie Calloway

(57) ABSTRACT

The present invention is directed to a method and apparatus for making nanofiber webs, wherein a source of process air is utilized to affect the spray pattern and quality of fibrillated material expressed from a die assembly including a multi-fluid opening. Appropriately, the aforementioned process air is defined herein as an alternate or ancillary air source apart from primary process air, which primary air is simultaneously supplied with the molten polymeric material to the fiber forming multi-fluid opening. The ancillary air source of the invention is further distinct from secondary air, which is also known in the art as quenching air. The ancillary air can be described as a continuous fluid curtain of shielding or shaping air.

23 Claims, 4 Drawing Sheets

U.S. PATENT DOCUMENTS

| | | | |
|---|---|---|---|
| 5,141,699 | A | 8/1992 | Meyer et al. |
| 5,160,746 | A | 11/1992 | Dodge, II et al. |
| 5,173,356 | A | 12/1992 | Eaton et al. |
| 5,236,641 | A | 8/1993 | Allen et al. |
| 5,273,565 | A | 12/1993 | Milligan et al. |
| 5,545,371 | A | 8/1996 | Lu |
| 5,582,907 | A | 12/1996 | Pall |
| 5,688,468 | A | 11/1997 | Lu |
| 5,733,635 | A | 3/1998 | Terakawa et al. |
| 5,824,248 | A | 10/1998 | Sweet et al. |
| 5,993,943 | A | 11/1999 | Bodaghi et al. |
| 6,001,303 | A | 12/1999 | Haynes et al. |
| 6,048,808 | A | 4/2000 | Kurihara et al. |
| 6,074,869 | A | 6/2000 | Pall et al. |
| 6,136,245 | A | 10/2000 | Lu |
| 6,183,670 | B1 | 2/2001 | Torobin et al. |
| 6,183,684 | B1 | 2/2001 | Lu |
| 6,296,463 | B1 | 10/2001 | Allen |
| 6,315,806 | B1 | 11/2001 | Torobin et al. |
| 6,382,526 | B1 | 5/2002 | Reneker et al. |
| 6,520,425 | B1 | 2/2003 | Reneker |
| 6,620,503 | B2 | 9/2003 | Qin et al. |
| 6,692,825 | B2 | 2/2004 | Qin et al. |
| 6,799,957 | B2 | 10/2004 | Allen |
| 6,824,729 | B2 | 11/2004 | Oin et al. |
| 6,846,450 | B2 | 1/2005 | Erickson et al. |
| 2003/0116874 | A1 | 6/2003 | Haynes |
| 2004/0102122 | A1 | 5/2004 | Boney et al. |

OTHER PUBLICATIONS

Written Opinion of the International Searching Authority, priority application No. PCT /US06/14719, Form PCT/ISA/237, Oct. 12, 2006, 2 pages.

International Preliminary Report on Patentability, priority application No. PCT /US06/14719, Form PCT/IB/373-Form PCT/ISA/237, Oct. 23, 2007, 4 pages.

Supplementary European Search Report, EP appln. No. 06750695.6-2425 PCT/US2006014719, May 7, 2008, 3 pages.

PROCESS AND APPARATUS FOR FORMING UNIFORM NANOFIBER SUBSTRATES

CROSS-REFERENCE TO RELATED APPLICATION

This application claims the benefit of priority Provisional Application No. 60/672,676, filed Apr. 19, 2005. the disclosures of which are incorporated herein by reference.

TECHNICAL FIELD

The present invention generally relates to a method and apparatus for making uniform nanofiber webs, and more specifically relates to a method of making uniform nanofiber webs, wherein a source of process air is utilized to affect the spray pattern and quality of fibrillated material as it is expressed from a die assembly including a multi-fluid opening.

BACKGROUND OF THE INVENTION

Meltspun technologies, which are known in the art to include the spunbond and meltblown processes, manage the flow of process gases, such as air, and polymeric material simultaneously through a die body to effect the formation of the polymeric material into continuous or discontinuous fiber. In most known configurations of meltblowing nozzles, hot air is provided through a passageway formed on each side of a die tip. The hot air heats the die and thus prevents the die from freezing as the molten polymer exits and cools. In this way the die is prevented from becoming clogged with solidifying polymer. In addition to heating the die body, the hot air, which is sometimes referred to as primary air, acts to draw, or attenuate the melt into elongated micro-sized filaments. In some cases, a secondary air source is further employed that impinges upon the drawn filaments so as to fragment and cool the filaments prior to being deposited on a collection surface. Typical meltblown fibers are known to consist of fiber diameters less than 10 microns.

More recently, methods of forming fibers with fiber diameters less than 1.0 micron, or 1000 nanometers, have been developed. These fibers are often referred to as ultra-fine fibers, sub-micron fibers, or nanofibers. Methods of producing nanofibers are known in the art and often make use of a plurality of multi-fluid nozzles, whereby an air source is supplied to an inner fluid passageway and a molten polymeric material is supplied to an outer annular passageway concentrically positioned about the inner passageway. While the physical properties of nanofiber webs are advantageous to a variety of nonwoven markets, commercial products have only reached limited markets due to associated cost.

U.S. Pat. No. 5,260,003 and No. 5,114,631 to Nyssen, et al., both hereby incorporated by reference, describe a meltblowing process and device for manufacturing ultra-fine fibers and ultra-fine fiber mats from thermoplastic polymers with mean fiber diameters of 0.2-15 microns. Laval nozzles are utilized to accelerate the process gas to supersonic speed; however, the process as disclosed has been realized to be prohibitively expensive both in operating and equipment costs.

U.S. Pat. No. 6,382,526 and No. 6,520,425 to Reneker, et al., also both hereby incorporated by reference, disclose a method of making nanofiber by forcing fiber forming material concentrically around an inner annular passageway of pressurized gas. The gas impinges upon the fiber forming material in a gas jet space to shear the material into ultra-fine fibers. U.S. Pat. No. 4,536,361 to Torobin, incorporated herein by reference, teaches a similar nanofiber formation method wherein a coaxial blowing nozzle has an inner passageway to convey a blowing gas at a positive pressure to the inner surface of a liquid film material, and an outer passageway to convey the film material. An additional method for the formation of nanofibers is taught in U.S. Pat. No. 6,183,670 to Torobin, et al., which is hereby incorporated by reference.

Spacing of nozzles within the die body may be arranged such that material exiting the nozzle arrangement can be collected in a more uniform manner upon a forming surface. It has been recognized that a linear formation of equally spaced nozzles may result in a striping pattern that is visibly noticeable within the collected web. The stripes are found to reflect the spacing between adjacent nozzles. The striping effect seen in the web can further be described as "hills and valleys" whereby the "hills" exhibit a noticeably higher basis weight than that of the "valleys". The industry may also refer to such basis weight inconsistencies as gauge bands.

U.S. Pat. Nos. 5,582,907 and 6,074,869, both incorporated herein by reference, address striping observed in meltblown webs by organizing nozzles into two linearly arranged parallel rows each having substantially equally spaced. Additionally, the two rows of nozzles are offset such that the nozzles are staggered in relationship to each other. Further, the staggered nozzles of the two rows are angled inward toward each other. In this fashion, each nozzle is utilizing a respective supply of primary process air, but lacks an ancillary air source to assist with web formation. These patents further assert external disruption of the polymeric material by an alternate gas source detracts from achievement of sufficient web uniformity.

A need remains for a process that can utilize multi-fluid openings for facilitating the distribution of molten polymer and a gas in the formation of nanofibers and further incorporates an ancillary gas source that assists with a uniform fiber collection across the width of the web.

SUMMARY OF THE INVENTION

The present invention is directed to a method and apparatus for making nanofiber webs, wherein a source of process air is utilized to affect the spray pattern and quality of fibrillated material expressed from a die assembly including a multi-fluid opening. Appropriately, the aforementioned process air is defined herein as an alternate or ancillary air source apart from primary process air, which primary air is simultaneously supplied with the molten polymeric material to the fiber forming multi-fluid opening. The ancillary air source of the invention is further distinct from secondary air, which is also known in the art as quenching air. The ancillary air can be described as a continuous fluid curtain of shielding or shaping air. While the use of air is preferred, the invention contemplates the use of alternate suitable gases, such as nitrogen. For the purpose of this disclosure, the ancillary air is referred to herein as a "fluid curtain nozzle" or "continuous air curtain".

According to the present invention, disclosed herein is a method of forming uniform nanofiber webs, The method includes a multi-fluid opening, wherein the opening includes a passage for directing a gas and a separate passage for directing a polymeric material through the opening. The method further includes at least one fluid curtain nozzle positioned in operative association with the multi-fluid opening. According to the method of the present invention, a molten polymeric material and a gas fluid is simultaneously supplied to separate respective passages of the multi-fluid opening. The gas is directed through the multi-fluid opening to impinge upon the polymeric material to thereby form a spray pattern. A fluid is also directed through the fluid curtain nozzle for controlling the spray pattern of nanofiber expressed from the multi-fluid opening and subsequently, the nanofiber is collected on a surface to form a uniform nanofiber web.

In addition to controlling the spray pattern of the nanofiber expressed from the multi-fluid opening, the fluid curtain is believed to further control the temperature of the multi-fluid opening, wherein the temperature of the multi-fluid opening may be elevated by fluid curtain.

In one embodiment, continuous air curtains are employed to affect the spray pattern and quality of fibrillated material as the material is expressed from a multi-fluid opening including an array of two or more multi-fluid nozzles. The multi-fluid nozzles have an inner passageway for directing a first fluid, such as gas, and an outer annular passageway surrounding the inner passageway for directing a second fluid or molten polymeric fiber forming material. In addition, at least one continuous air curtain is positioned in operative association with the complete plural nozzle array to affect the polymeric spray formation pattern, which can be generally described as conical. The one or more air curtains are observed to "compress" and shape the spray pattern of fibrillated material that is emitted from the nozzles thereby decreasing the distance from which the fibers are spaced across the conic spray formation. Further, as the air curtains impinge upon the polymeric spray to affect the spray pattern, the air curtains can also function to shield the spray formations between adjacent plural nozzle arrays to diminish interaction or comingling of the fibrous material between adjacent nozzle arrays. Reduced comingling of the fibrillated polymeric spray of nanofiber between adjacent nozzle arrays is believed to significantly improve the uniformity of the web as the nanofibers are gathered onto a collection surface.

In one contemplated embodiment, a method for forming the uniform nanofiber web comprises an array of two or more multi-fluid nozzles preferably aligned in a generally linear arrangement, wherein a plurality of the multi-fluid nozzle arrays are positioned parallel to one another across the width of the fiber forming apparatus. In addition, at least one air curtain nozzle is positioned in operative association with each of the plural multi-fluid nozzle arrays, wherein the air curtain nozzle defines a generally elongated slot through which fluid is directed for formation of the fluid (air) curtain.

The present invention also contemplates the use of one or more air curtains with various other multi-fluid opening configurations, such as slot dies. Examples of slot die configurations include a double slot die and a single slot die. It is believed that the use of one or more air curtains in operative association with the double slot multi-fluid opening or single slot multi-fluid opening affects fiber formation and enhances the uniformity of the resultant web.

Other features and advantages of the present invention will become readily apparent from the following detailed description, the accompanying drawings, and the appended claims.

DETAILED DESCRIPTION

Figure 1:
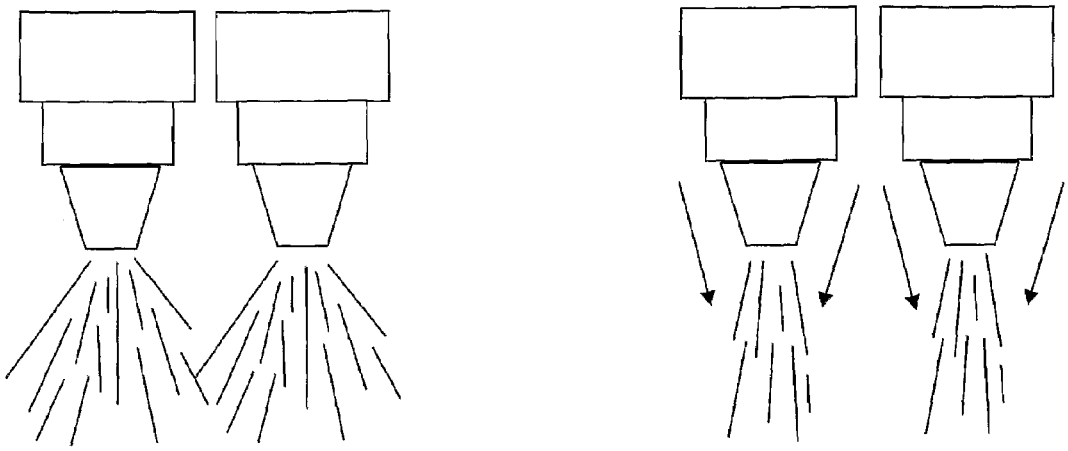
FIG. 1 is a schematic diagram of the effect of the air curtains on the polymeric spray formations of the multi-fluid nozzle configurations.

While the present invention is susceptible of embodiment in various forms, there is shown in the drawings, and will hereinafter be described, a presently preferred embodiment of the invention, with the understanding that the present disclosure is to be considered as an exemplification of the invention, and is not intended to limit the invention to the specific embodiment illustrated.

The method of making nanofiber webs in accordance with the present invention can be practiced in keeping with the teachings of U.S. Pat. Nos. 4,536,361 and 6,183,670, both previously incorporated herein by reference. The present invention further contemplates a method of forming fibrillated nanofibers and nanofiber webs, wherein one embodiment, shown in FIG. 2, includes a die assembly 20 including an array of plural multi-fluid nozzles 28. Each nozzle defines an inner fluid passageway for directing a gas 24, and an outer passageway, wherein the outer passageway surrounds the inner passageway for directing polymeric material 22 through the nozzle. In addition, at least one fluid curtain nozzle 26, or "air curtain" nozzle, is positioned in operative association with each array of plural multi-fluid nozzles. While the use of air through the fluid curtain nozzle may be preferred, the invention contemplates the use of alternate suitable gases, such as nitrogen.

Figure 2:
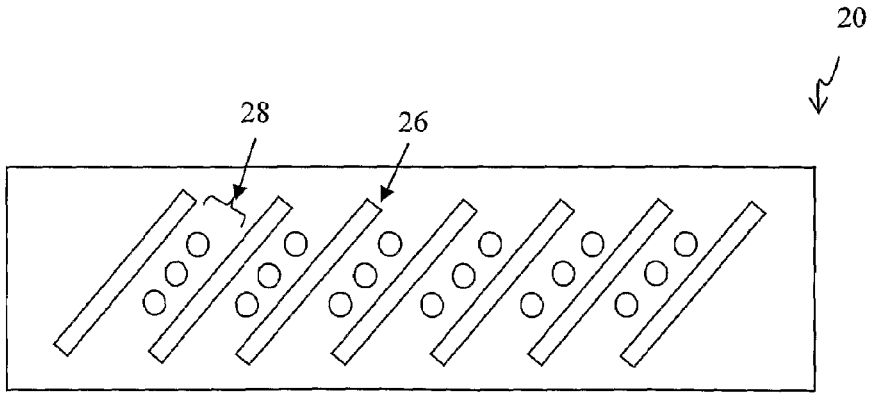
FIG. 2 is a schematic diagram of an array of annular nozzles embodying the principle of the present invention.

FIG. 1 is a schematic view illustrating the influence of the air curtains in relation to individual nozzles. The air curtains shape and shield the spray pattern of the nozzles to reduce comingling between adjacent fibrous spray patterns of fibrillated material. FIG. 2 is a schematic view of the multi-fluid nozzle arrays 28, wherein at least one air curtain 26 is positioned within operative association with the array 28. As demonstrated in FIG. 1, the air curtains shape the spray pattern of fibrillated material emitted from the nozzles within the array and further shields the spray formations of adjacent multi-fluid nozzle arrays.

Figure 3:
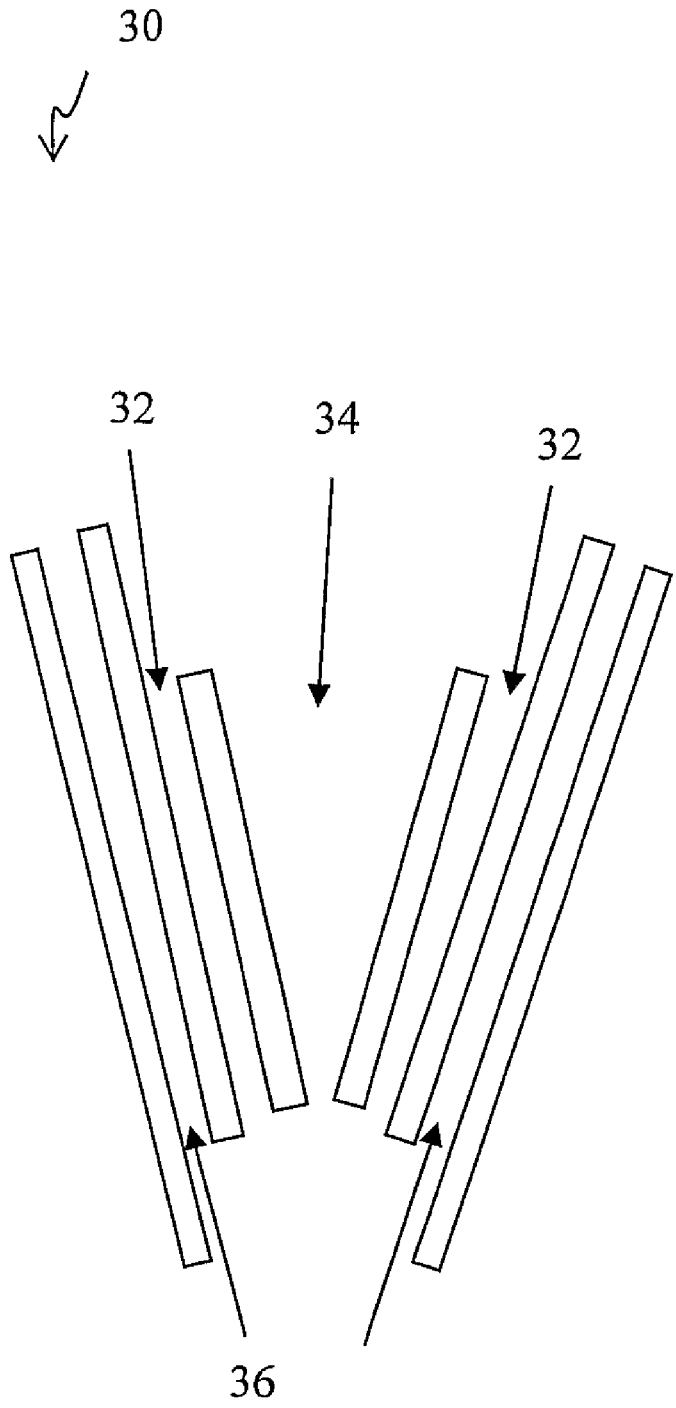
FIG. 3 is a schematic diagram of a slot die assembly embodiment of the present invention.

It is also in the purview of the present invention to provide a die assembly including a slot configuration for delivery of a gas and a polymeric material. In such a configuration, it is contemplated to provide a polymeric material as a continuous film on a film forming surface, wherein non-limiting examples of film forming surfaces may include linear, wave-like, grooved, and the like. FIG. 3 is an illustrative embodiment a slot configuration, wherein the film forming surface 32 is linear. The slot configuration shown in FIG. 3, is also referred to as a double slot-die assembly 30, A double slot-die assembly defines a pair of linear film forming surfaces 32 arranged in converging relationship to each other. In accordance with the invention, the double slot-die assembly defines an elongated gas passage 34 for directing pressurized gas against molten polymer on both pair of linear film forming surfaces 32. Film fibrillation is believed to occur once the path(s) of the film and gas intersect which may begin to occur as the film descends against the film forming surfaces and may continue to occur as the film is deposited into the gaseous stream. In addition, at least one fluid curtain nozzle 36, or "air curtain" nozzle, is positioned in operative association with each film forming surface. Again, while the use of air through the fluid curtain nozzle may be preferred, the invention contemplates the use of alternate suitable gases, such as nitrogen.

Figure 4:
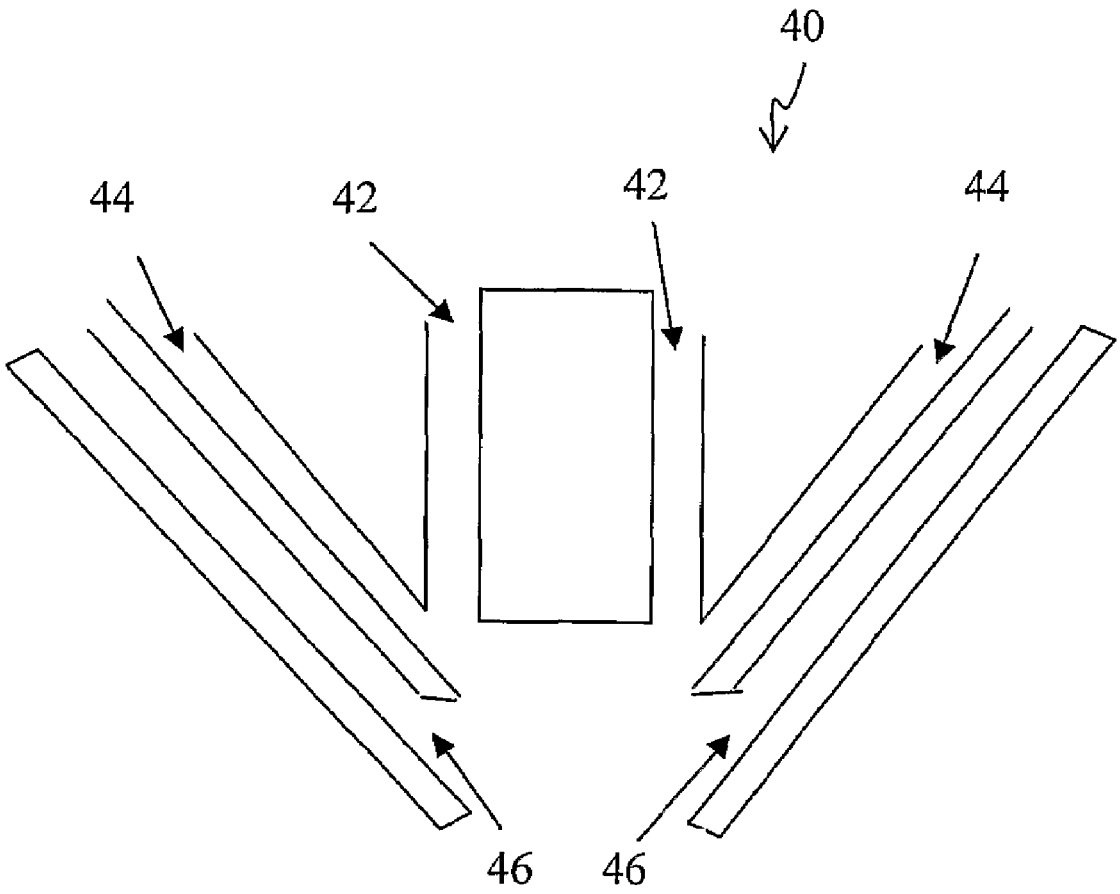
FIG. 4 is a schematic diagram of an alternate slot die assembly embodiment of the present invention.

In another illustrative embodiment, as shown in FIG. 4, another die assembly 40 including a slot configuration, wherein a pair of linear film forming surfaces 42 are defined and arranged in parallel relationship to each other. Further, a pair of gas passages 44 arranged in converging relationship for each directing pressurized gas for impingement against respective film forming surfaces 42. In addition, this embodiment, further includes at least one fluid curtain nozzle 46, or "air curtain" nozzle, is positioned in operative association with each film forming surface.

Figure 5:
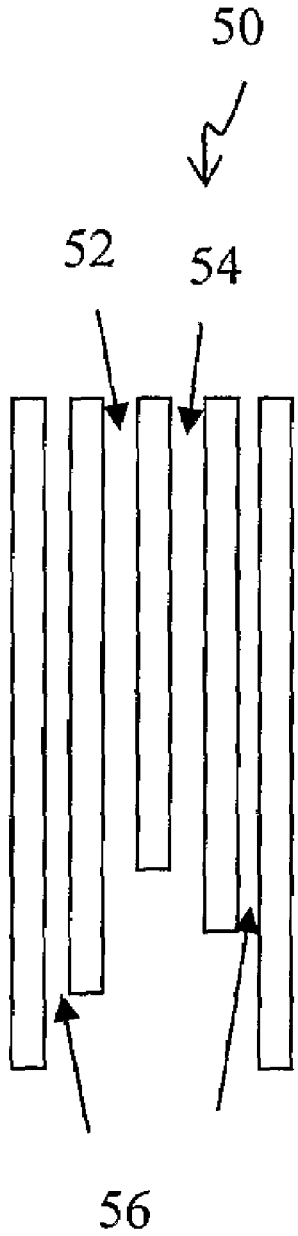
FIG. 5 is a schematic diagram of still another alternate non-annular embodiment of the present invention.

In yet another illustrative embodiment, as shown in FIG. 5, the slot configuration is also referred to as a single slot-die assembly 50, which defines at least one gas exit passage 54 and one film forming surface 52. Pressurized gas from a gas plenum chamber (not shown) is directed through a gas exit passage 54, which in this illustrated embodiment is disposed at an acute angle to the film forming surface 52. In addition, at least one fluid curtain nozzle 56, or "air curtain" nozzle, is positioned in operative association with the film forming surface.

In yet another embodiment, the slot configuration includes a film forming surface, a gas exit passage, and an impingement surface, wherein the gas exiting the die is directed against the formed film on an impingement surface. In such an embodiment, the film forming surface may be a horizontal surface, otherwise referred to as 0°, or positioned at an angle up to about 80°. Preferably, the film forming surface is positioned at about 0° to about 60°. The film forming surface can be described to also have a length. The film forming surface preferably has a length of about 0 to about 0.120 inches. In addition, the impingement surface also has a preferred surface position, wherein the impingement surface may be perpendicular to the film forming surface or otherwise described as having a 90° angle relative to the film forming surface or the impingement surface may be at an angle than 90° relative to the film forming surface. Further, the impingement surface has a preferred length of between about 0-0.150 inches, more preferably between about 0-0.060 inches, and most preferably between about 0-0.001 inches.

According to the invention molten polymeric material suitable for formation of the nanofibers and nanofiber webs of the present invention are those polymers capable of being melt-spun including, but are not limited to polyolefin, polyamide, polyester, poly(vinylchloride), polymethylmethacrylate (and other acrylic resins), polystyrene, polyurethane, and copolymers thereof (including ABA type block copolymers), polyvinylalcohol in various degrees of hydrolysis in cross-linked and non-cross-linked forms, as well as elastomeric polymers, plus the derivatives and mixtures thereof. Modacrylics, polyacrylonitriles, aramids, melamines, and other flame-retardant polymers have been contemplated as well. The polymers may be further selected from homopolymers; copolymers, and conjugates and may include those polymers having incorporated melt additives or surface-active agents.

As illustrated in FIG. 1, the polymeric material is supplied to the outer passageways of the nozzle, a fluid, typically air, is simultaneously supplied through the respective inner passageway of each nozzle to impinge upon the polymeric material directed through the respective outer passageway to thereby form a spray pattern of fibrillated nanofibers from each nozzle. The spray pattern formed from the array of plural multi-fluid nozzles is affected by at least one air curtain nozzle, wherein said air curtain nozzle defines a generally elongated slot, as illustrated in FIG. 2.

In such an embodiment, the slot may demonstrate a linear configuration, which is positioned in operative association with the entire array of nozzles to control and shape the spray patterns of the array. Preferably, the slot has a length of about at least the length of the plural multi-fluid nozzle array, and most preferably has a length which is approximately equal to the length of the array plus two times the center-to-center spacing of the individual nozzles. Thus, in a current embodiment, wherein a nozzle array includes three individual nozzles spaced approximately 0.42 in, center-to-center an associated air curtain nozzle has a slot length of approx. 1.7 in. Further, the slot preferably is provided with a width of about 0.003 in. to about 0.050 in. Air temperatures suitable for use with the process of the present invention preferably exhibit a range between 10° C. and 400° C., and more preferably exhibit a range between 25° C. and 360° C.

The air curtain has been observed to further shield the spray patterns of adjacent multi-fluid nozzle arrays, thereby reducing the degree of comingling between the multi-fluid nozzle arrays, as well as minimizing excess comingling of fibers of adjacent multi-fluid nozzles within an array. In addition, with respect to the slot configuration embodiments, the air curtain is further believed to affect the shape of the spray pattern of the fibrillated film. Without intending to be bound by theory, it is believed that a controlled spray pattern of fibrillated material results in a more uniform collection of nanofibers on a surface to produce a more uniform web.

Web uniformity usually refers to the degree of consistency across the width of the web and can be determined by several systems of measurement, including, but not limited to, coefficient of variation of pore diameter, air permeability, and opacity. Web uniformity metrics tend to be basis weight dependent. The nonwoven nanofiber fabric of the present invention may exhibit basis weights ranging from very light to very heavy, wherein the range captures fabric less than 5 gsm through fabrics greater than 200 gsm.

One acceptable uniformity metric is disclosed in U.S. Pat. No. 5,173,356, which is hereby incorporated by reference and includes collecting small swatches taken from various locations across the width of the web (sufficiently far enough away from the edges to avoid edge effects) to determine a basis weight uniformity. Additional acceptable methods for evaluating uniformity may be practiced in accordance with original paper, "Nonwoven Uniformity—Measurements Using Image Analysis", disclosed in the Spring 2003 International Nonwovens Journal Vol. 12, No. 1, also incorporated by reference.

Despite the aforementioned methods of evaluating uniformity, lighter weight webs may nonetheless exhibit non-uniform performance characteristics due to differences in the intrinsic properties of the individual web fibers. As taught in U.S. Pat. No. 6,846,450, incorporated herein by reference, light weight webs may be evaluated for uniformity by measuring properties of the fibers rather than the web. It's been further contemplated to measure web uniformity in an inline process by way of various commercially available scanning devices that monitor web inconsistencies. In addition to improved web uniformity, it's believed the nanofiber web formed on the collection surface exhibits a loftier caliper as the nanofibers are deposited in a more controlled manner through the use of air curtains.

The present invention further contemplates the use of air curtains to improve the quality of the fibrillated material by forming more uniform nanofibers and creating a controlled environment from the time the polymer is first sprayed from the die assembly until the time the formed nanofibers are gathered on a collection surface. Fiber uniformity may be measured by those methods known in the art, such as by a scanning electron microscopic once the fabric is offline or inline by way of ensemble laser diffraction, as disclosed in original paper, "Ensemble Laser Diffraction for Online Measurement of Fiber Diameter Distribution During the Melt Blown Process, of the Summer 2004 International Nonwovens Journal, which is hereby incorporated by reference. Without intending to be bound by theory, when air curtains are used in conjunction with an array or two or more multi-fluid nozzles, it is believed that the air curtains form a controlled gradient-like effect of ancillary air as it diverges from the multi-fluid nozzle tip toward the fiber collection surface. In the region of the nozzle tip, the air currents influence the fiber formation process by acting to control the temperature at the nozzle tip. This control can include elevating the temperature of the fluid nozzles with the fluid (air) current. As the air from the curtains diverges from the nozzle tip, the air curtains of the invention are believed to entrain surrounding environmental air, which acts to isolate the newly formed nanofibers, while minimizing the deleterious effects of "shot" on web formation. Shot is known in the art as a collection of polymer that fails to form fiber during the fiber formation process and deposits onto the fiber collection surface as a polymeric globule deleteriously affecting the web formation.

In accordance with the present invention, the formed nanofibers are generally self bonding when deposited on a collection surface; however, it is in the purview of the present invention that the nanofiber web may be further consolidated by thermal calendaring or other bonding techniques known to those skilled in the art. It is further in the purview of the invention to combine the nonwoven nanofiber web of the present invention with additional fibrous and non-fibrous substrates to form a multilayer construct. Substrates which can be combined with the nanofiber web (N) may be selected from the group consisting of carded webs (C), spunbond webs (S), meltblown webs (M), and films (F) of similar or dissimilar basis weights, fiber composition, fiber diameters, and physical properties. Non-limiting examples of such constructs include S-N, S-N-S, S-M-N-M-S, S-N-N-S, S-N-S/S-N-S, S-M-S/S-N-S, C-N-C, F-N-F, etc., wherein the multilayer constructs may be bonded or consolidated by way of hydraulic needling, through air bonding, adhesive bonding, ultrasonic bonding, thermal point bonding, smooth calendaring, or by any other bonding technique known in the art.

The nonwoven construct comprised of the uniform nanofiber web may be utilized in the manufacture of numerous home cleaning, personal hygiene, medical, and other end use products where a nonwoven fabric can be employed. Disposable nonwoven undergarments and disposable absorbent hygiene articles, such as a sanitary napkins, incontinence pads, diapers, and the like, wherein the term "diaper" refers to an absorbent article generally worn by infants and incontinent persons that is worn about the lower torso of the wearer can benefit from the improved uniformity of a nanofiber nonwoven in the absorbent layer construction.

In addition, the material may be utilized as medical gauze, or similar absorbent surgical materials, for absorbing wound exudates and assisting in the removal of seepage from surgical sites. Other end uses include wet or dry hygienic, antimicrobial, or hard surface wipes for medical, industrial, automotive, home care, food service, and graphic arts markets, which can be readily hand-held for cleaning and the like.

The nanofiber webs of the present invention may be included in constructs suitable for medical and industrial protective apparel, such as gowns, drapes, shirts, bottom weights, lab coats, face masks, and the like, and protective covers, including covers for vehicles such as cars, trucks, boats, airplanes, motorcycles, bicycles, golf carts, as well as covers for equipment often left outdoors like grills, yard and garden equipment, such as mowers and roto-tillers, lawn furniture, floor coverings, table cloths, and picnic area covers.

The nanofiber material may also be used in top of bed applications, including mattress protectors, comforters, quilts, duvet covers, and bedspreads. Additionally, acoustical applications, such as interior and exterior automotive components, carpet backing, insulative and sound dampening appliance and machinery wraps, and wall coverings may also benefit from the nanofiber web of the present invention. The uniform nanofiber web is further advantageous for various filtration applications, including bag house, plus pool and spa filters.

It has also been contemplated that a multilayer structure comprised of the nanofiber web of the present invention may be embossed or imparted with one or more raised portions by advancing the structure onto a forming surface comprised of a series of void spaces. Suitable forming surfaces include wire screens, three-dimensional belts, metal drums, and laser ablated shells, such as a three-dimensional image transfer device. Three-dimensional image transfer devices are disclosed in U.S. Pat. No. 5,098,764, which is hereby incorporated by reference; with the use of such image transfer devices being desirable for providing a fabric with enhanced physical properties as well as an aesthetically pleasing appearance.

Depending on the desired end use application of the uniform nonwoven nanofiber web, specific additives may be included directly into the polymeric melt or applied after formation of the web. Suitable non-limiting examples of such additives include absorbency enhancing or deterring additives, UV stabilizers, fire retardants, dyes and pigments, fragrances, skin protectant, surfactants, aqueous or non-aqueous functional industrial solvents such as, plant oils, animal oils, terpenoids, silicon oils, mineral oils, white mineral oils, paraffinic solvents, polybutylenes, polyisobutylenes, polyalphaolefins, and mixtures thereof, toluenes, sequestering agents, corrosion inhibitors, abrasives, petroleum distillates, degreasers and the combinations thereof. Additional additives include antimicrobial composition, including, but not limited to iodines, alcohols, such as such as ethanol or propanol, biocides, abrasives, metallic materials, such as metal oxide, metal salt, metal complex, metal alloy or mixtures thereof, bacteriostatic complexes, bactericidal complexes, and the combinations thereof.

From the foregoing, it will be observed that numerous modifications and variations can be affected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

What is claimed is:

1. A method of forming uniform nanofiber webs, comprising the steps of:

providing a multi-fluid opening, said opening defining a fluid passageway for directing gas, and a separate passageway for directing polymeric material through said opening;

providing at least one fluid curtain nozzle positioned in operative association with said multi-fluid opening, wherein said at least one fluid curtain nozzle defines a generally elongated slot;

supplying molten polymeric material to said multi-fluid opening and simultaneously supplying a gas fluid to said opening so that said gas is directed through the respective gas passageway of said multi-fluid opening to impinge upon the polymeric material directed through the respective polymeric passageway to thereby form a spray pattern of nanofibers from each said opening;

supplying a fluid directed through said generally elongated slot of said at least one fluid curtain nozzle to form a fluid curtain for controlling the spray patterns of said multi-fluid openings; and depositing said nanofibers on a collecting surface to form said uniform nanofiber web.

2. A method in accordance with claim 1, wherein:

said spray pattern from each said multi-fluid opening is generally conic.

3. A method in accordance with claim 1, wherein said multi-fluid opening is a slot configuration.

4. A method in accordance with claim 3, wherein said slot configuration is a single slot or a double slot.

5. A method in accordance with claim 1, wherein:

said elongated slot is of a linear configuration.

6. A method in accordance with claim 1, wherein:

said fluid supplied to said multi-fluid opening and said fluid supplied to said fluid curtain nozzle each comprises a gaseous fluid.

7. A method in accordance with claim 1, including, controlling the temperature of the multi-fluid opening with said fluid curtain.

8. A method in accordance with claim 7, wherein, said controlling step includes elevating the temperature of the fluid opening with said fluid curtain.

9. A method of forming uniform nanofiber webs, comprising the steps of:

providing an array of a plurality of multi-fluid nozzles, each said nozzle defining an inner fluid passageway, and an outer passageway surrounding said inner passageway for directing polymeric material through said nozzle;

providing at least one fluid curtain nozzle positioned in operative association with each of the plural multi-fluid nozzles of said array, wherein said at least one fluid curtain nozzle defines a generally elongated slot;

supplying molten polymeric material to said plurality of said multi-fluid nozzles so that said polymeric material is directed through the respective outer passageways of said nozzles, and simultaneously supplying a fluid to said nozzles so that said fluid is directed through the respective inner passageway of each said nozzle to impinge upon the polymeric material directed through the respective outer passageway to thereby form a spray pattern of nanofibers from each said nozzle;

supplying a fluid directed through said generally elongated slot of said at least one fluid curtain nozzle to form a fluid curtain for controlling the spray patterns of said multi-fluid nozzles of said array; and depositing said nanofibers on a collecting surface to form said uniform nanofiber web.

10. A method in accordance with claim 9, wherein:

said spray pattern from each said multi-fluid nozzle is generally conic.

11. A method in accordance with claim 9, wherein:

said elongated slot is of a linear configuration.

12. A method in accordance with claim 9, wherein:

said fluid supplied to said multi-fluid nozzles and said fluid supplied to said fluid curtain nozzle each comprises a gaseous fluid.

13. A method in accordance with claim 9, including:

providing another of said array of a plurality of multi-fluid nozzles, and positioning said fluid curtain nozzle intermediate said arrays of multi-fluid nozzles.

14. A method in accordance with claim 9, including controlling the temperature of the multi-fluid nozzles with said fluid curtain.

15. A method in accordance with claim 14, wherein, said controlling step includes elevating the temperature of the fluid nozzles with said fluid current.

16. An apparatus for forming nanofibers, comprising:

an array of a plurality of multi-fluid nozzles, each said nozzle defining an inner fluid passageway, and an outer passageway surrounding said inner passageway for directing polymeric material through said nozzle, each said nozzle forming a spray pattern of nanofibers formed from said polymeric material when the polymeric material is impinged by fluid directed through said inner passageway; and a fluid curtain nozzle positioned in operative association with each of said plural multi-fluid nozzles of said array, said fluid curtain nozzle defining a slot through which fluid is directed to form a fluid curtain for controlling the spray patterns of said multi-fluid nozzles of said array, wherein said slot of said fluid curtain nozzle has a generally elongated configuration.

17. An apparatus in accordance with claim 16, wherein:

said slot of said fluid curtain nozzle has an elongated, linear configuration.

18. An apparatus in accordance with claim 16, wherein:

said spray pattern of each said multi-fluid nozzle is generally conic.

19. An apparatus in accordance with claim 16, including:

another array of said plurality of multi-fluid nozzles, said fluid curtain nozzle being positioned intermediate said arrays of multi-fluid nozzles.

20. An apparatus in accordance with claim 16, wherein:

said fluid curtain nozzle influences said multi-fluid nozzles by affecting the tip of said nozzles.

21. An apparatus in accordance with claim 20, wherein:

said fluid curtain nozzle elevates the temperature at the tip of said multi-fluid nozzles.

22. A method of forming uniform nanofiber webs, comprising the steps of:

providing an array of a plurality of multi-fluid nozzles, each said nozzle defining an inner fluid passageway, and an outer passageway surrounding said inner passageway for directing polymeric material through said nozzle;

providing another of said array of a plurality of multi-fluid nozzles;

providing at least one fluid curtain nozzle positioned intermediate said anays of multi-fluid nozzles and in operative association with each of the plural multi-fluid nozzles of said array;

supplying molten polymeric material to said plurality of said multi-fluid nozzles so that said polymeric material is directed through the respective outer passageways of said nozzles, and simultaneously supplying a fluid to said nozzles so that said fluid is directed through the respective inner passageway of each said nozzle to impinge upon the polymeric material directed through the respective outer passageway to thereby form a spray pattern of nanofibers from each said nozzle;

supplying a fluid through said at least one fluid curtain nozzle to form a fluid curtain for controlling the spray patterns of said multi-fluid nozzles of said array; and depositing said nanofibers on a collecting surface to form said uniform nanofiber web.

23. An apparatus for forming nanofibers, comprising:

an array of a plurality of multi-fluid nozzles, each said nozzle defining an inner fluid passageway, and an outer passageway sunounding said inner passageway for directing polymeric material through said nozzle, each said nozzle forming a spray pattern of nanofibers formed from said polymeric material when the polymeric material is impinged by fluid directed through said inner passageway;

another array of said plurality of multi-fluid nozzles; and a fluid curtain nozzle positioned intermediate said arrays of multi-fluid nozzles and in operative association with each of said plural multi-fluid nozzles of said anay, said fluid curtain nozzle defining a slot through which fluid is directed for controlling the spray patterns of said multi-fluid nozzles of said array.

* * * * *

UNITED STATES PATENT AND TRADEMARK OFFICE

CERTIFICATE OF CORRECTION

PATENT NO. : 7,628,941 B2
APPLICATION NO. : 12/095329
DATED : December 8, 2009
INVENTOR(S) : Tim Krause et al.

It is certified that error appears in the above-identified patent and that said Letters Patent is hereby corrected as shown below:

In column 10, line 45, in Claim 22, please replace "anays" with -- arrays --;

In column 10, line 65, in Claim 23, please replace "sunounding" with -- surrounding --;

In column 12, line 1, in Claim 23, please replace "anay" with -- array --.

Signed and Sealed this

Fourth Day of May, 2010

David J. Kappos

David J. Kappos
*Director of the United States Patent and Trademark Office*